US005830617A

United States Patent [19]

Koyama et al.

[11] Patent Number: 5,830,617

[45] Date of Patent: Nov. 3, 1998

[54] TONER FOR DEVELOPING AN ELECTROSTATIC LATENT IMAGE, DEVELOPER AND A METHOD OF PRODUCING AN IMAGE USING THE TONER

[75] Inventors: Mikio Koyama; Kenji Hayashi; Tomoe Kikuchi; Hiroshi Yamazaki, all of Hino, Japan

[73] Assignee: Konica Corporation, Japan

[21] Appl. No.: 654,702

[22] Filed: May 29, 1996

[30] Foreign Application Priority Data

Jun. 2, 1995 [JP] Japan ..... 7-136716
Sep. 20, 1995 [JP] Japan ..... 7-241341

[51] Int. Cl.[6] ..... G03G 9/087
[52] U.S. Cl. ..... 430/109; 430/111; 430/137
[58] Field of Search ..... 430/111, 109, 430/137, 114

[56] References Cited

U.S. PATENT DOCUMENTS 5,411,833 5/1995 Swidler ..... 430/109
5,415,964 5/1995 Hayashi et al. ..... 430/106
5,547,804 8/1996 Nishizawa et al. ..... 430/114
5,589,313 12/1996 Takezawa et al. ..... 430/111

FOREIGN PATENT DOCUMENTS 0410483 1/1991 European Pat. Off. .
0445986 9/1991 European Pat. Off. .
0535246 4/1993 European Pat. Off. .
6-329947 11/1994 Japan .

OTHER PUBLICATIONS

Patent & Trademark English–Language Translation of JP 6–329947 (Pub Nov. 1994).

Search Report EP 96 10 8674 and Annex.

Patent Abstracts of Japan Publication of #JP6095429 vol. 18, No. 362, (P–1766), Jul. 1994.

*Primary Examiner*—Janis L. Dote
*Attorney, Agent, or Firm*—Jordan B. Bierman; Bierman, Muserlian and Lucas

[57] ABSTRACT

Disclosed is a toner for developing an electrostatic latent image, said toner having BET specific surface area of not less than $5m^2/g$.

16 Claims, 3 Drawing Sheets

TONER FOR DEVELOPING AN ELECTROSTATIC LATENT IMAGE, DEVELOPER AND A METHOD OF PRODUCING AN IMAGE USING THE TONER

FIELD OF THE INVENTION

The present invention relates to a method of forming an electrostatic latent image by using a toner having stable electrification performance, rapid developing speed, excellent durability and reduced fogging occurrence.

BACKGROUND OF THE INVENTION

Recent years, electrophotographic developing method has been used in various fields. It is employed, for example, not only in the field of copying machines but also in the fields of printer, which is an output terminal of computers, color copying machines, color printers, etc. With the advancement of utility, high image quality has been demanded. Accordingly, a toner having improved performances such as electrification property has been demanded.

For the purpose of improvement of image qualities, there have been a variety of proposals for enhancement of image quality by the use of toner having small particle size. However, when toner particle size is reduced, since adhesive force between toner particles is increased due to so-called Vander Waals force, it becomes difficult to confer required electrification property on the toner. Thus this often leads to the presence of large quantity of insufficiently or excessively electrified toner particles, so that fogging in the image causes, problems such as stain occurrence in a development device or carrier in two-component type developers, and the problems of decreasing durability have grown.

This tendency remarkably takes place in the case of toner having small particle size, however, the same phenomenon is observed in the toner having the conventional particle size employed in the art. Further, electrification property, which has been regarded as a serious problem came to be considered as one of deficiencies in the case of copying machines with high speed, high image quality, and durability.

Since adhesive force of the toner having small particle size is large, toner transferring property from a photoreceptor to image receiving material and cleaning capability of residual untransfered toner are deteriorated.

SUMMARY OF THE INVENTION

In the view of the problems mentioned above, the object of the present invention is to provide a toner for developing electrostatic latent images, with which generation of insufficiently or excessively electrified toner particles can be reduced, and stable electrification performance can be obtained.

Another object of the present invention is to provide toner for developing an electrostatic latent images, with which quick development, excellent in durability without causing fog even in the repeated use for a long period of time, may be attained.

Still another object of the present invention is to provide a method of forming an image, in which the above-mentioned toner can suitably be applied.

The above-mentioned objects of the present invention can be solved by the following items:

(1) A toner for developing an electrostatic latent image, comprising toner particles having BET specific surface area of not less than 5 $m^2/g$.

(2) A developer for developing an electrostatic latent image characterized in comprising toner particles of which BET specific surface area is not less than 5 $m^2/g$.

(3) A method of forming a toner image by visualizing an electrostatic latent image formed on a photoreceptor with toner, wherein said toner has BET specific surface area of not less than 5 $m^2/g$.

(4) A method of forming a toner image by visualizing an electrostatic latent image formed on a photoreceptor with toner, said method comprising a step of transferring said toner image formed on the photoreceptor onto a transferring material, wherein said toner having BET specific surface area of not less than 5 $m^2/g$.

(5) A method of forming an image comprising steps of cleaning and removing toner remained on the photoreceptor after transferring said toner image formed on the photoreceptor onto a transferring material, wherein said toner has BET specific surface area of not less than 5 $m^2/g$.

(6) A toner for developing an electrostatic latent image, comprising toner having BET specific surface area of not less than 5 $m^2/g$ and having a shape coefficient of 1.01 to 1.5.

(7) A toner for developing an electrostatic latent image, comprising a resin having BET specific surface area of not less than 5 $m^2/g$ and having a ratio of a weight average molecular weight (Mw) to a number average molecular weight (Mn) of less than 5.

(8) A developer comprising a toner for developing an electrostatic latent image, said toner having BET specific surface area of not less than 5 $m^2/g$ and having a shape coefficient of 1.01 to 1.5.

(9) A developer comprising a toner for developing an electrostatic latent image, said toner comprising a resin having BET specific surface area of not less than 5 $m^2/g$ and having a ratio of a weight average molecular weight (Mw) to a number average molecular weight (Mn) of less than 5.

(10) An image forming method of developing an electrostatic latent image on a photoreceptor with toner, wherein said toner has BET specific surface area of not less than 5 $m^2/g$ and has a shape coefficient of 1.01 to 1.5.

(11) An image forming method of developing an electrostatic latent image on a photoreceptor with toner, wherein said toner has BET specific surface area of not less than 5 $m^2/g$ and has a ratio of a weight average molecular weight (Mw) to a number average molecular weight (Mn) of less than 5.

(12) An image forming method of transferring toner image formed on an image carrying member onto an image receiving material, wherein said toner has BET specific surface area of not less than 5 $m^2/g$ and has a shape coefficient of 1.01 to 1.5.

(13) An image forming method of transferring toner image formed on an image carrying member onto an image receiving material, wherein said toner has BET specific surface area of not less than 5 $m^2/g$ and has a ratio of a weight average molecular weight (Mw) to a number average molecular weight (Mn) of less than 5.

(14) A method of forming an image comprising steps of cleaning and removing toner remained on the photoreceptor after transferring said toner image formed on the photoreceptor onto a transferring material, wherein said toner has BET specific surface area of not less than 5 $m^2$ and has a shape coefficient of 1.01 to 1.5.

(15) A method of forming a n image comprising steps of cleaning and removing toner remained on the photoreceptor after transferring said toner image formed on the photoreceptor onto a transferring material, wherein said toner has BET specific surface area of not less than 5 $m^2/g$ and has a ratio of a weight average molecular weight (Mw) to a number average molecular weight (Mn) of less than 5.

EXPLANATION OF SYMBOLS

Figure 1:
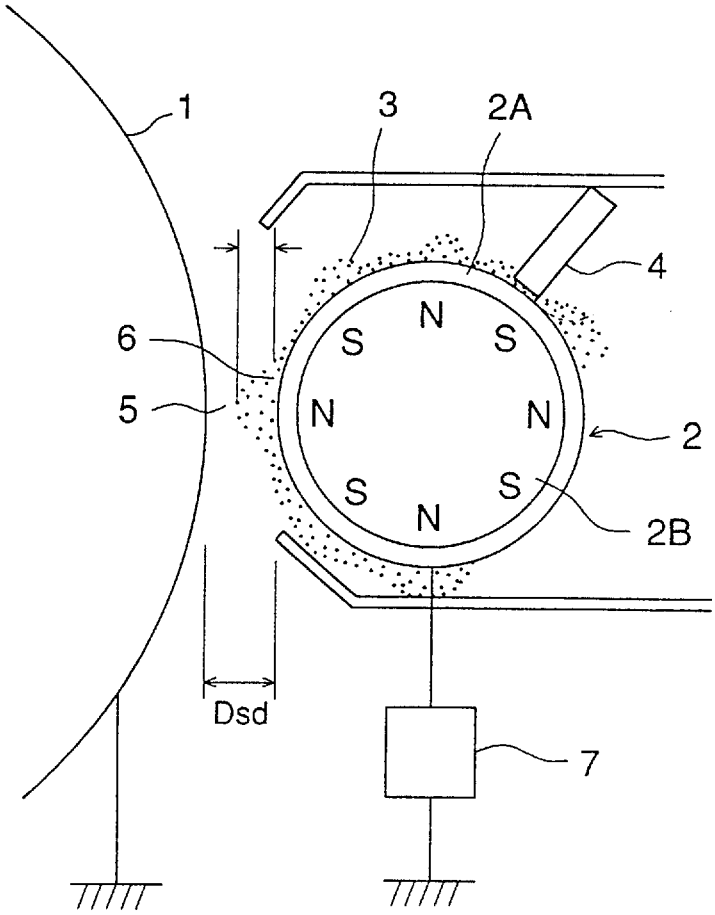
FIG. 1 is a conceptual drawing showing an example of non-contact developing method.

1 Photoreceptor
2 Developer carrier
2A development sleeve
2B Magnet
3 Two-component developer containing toner of the present invention.
4 Developer layer thickness regulating member
5 Development domain
6 Developer Layer
7 Power source for forming an alternating electric field
11 Charging device
12 Developing device
13 Cleaning unit
14 Photoreceptor drum
15 Transfer drum
16 Transport unit
17 Adsorption electrode
18 Transfer electrode
19 Peeling-off electrode
20 de-electrification electrode
21 Transport section
31 Cleaning blade
33 Holder
34 Direction of rotation of photoreceptor

DETAILED DESCRIPTION OF THE INVENTION

Herein below, the present invention is explained in detail. The toner of the present invention has a BET specific surface area of not less than 5 $m^2$, and this BET specific surface area is measured by one-point method based on nitrogen adsorption method, and specifically, by the use of Flow Soap 2300 measuring apparatus manufactured by Shimazu Seisaksho Co., Ltd.

It is preferable that the toner of the present invention has a shape coefficient of 1.01 to 1.5, and further, more preferable, of 1.05 to 1.3. The shape coefficient is defined by a ratio of a circular equivalent length of a toner particle to the circular equivalent length of the toner particle, and more specifically, it is defined by the following formula.

A shape Coefficient=(the circular length of a toner)/(the circular equivalent length of the toner)

$$L/(2\pi\sqrt{A/\pi})$$

In the above formula, L denotes the circular length of a toner particle ($\mu$m), A denotes the projected area of the toner particle ($\mu m^2$).

L and A in the above formula are measured by projecting toner particles and measuring L and A of the projected image, and more specifically, the toner particles are enlarged 1,000 times by the SEM (Scanning Electron Microscope), and the projected image is photographed to measure L and A of 100 to 1,000 samples and then, each of average values of L and A is measured by the use of an image analyzer.

The toner of the present invention possessing the above-mentioned shape coefficient, has not only a shape relatively similar to a spherical but also large surface area. It is considered that, since the toner of the present invention has the above-mentioned specific shape and the large surface, the objects of the present invention can be attained. That is to say, while having a shape relatively similar to a spherical and, at the same time, it has large surface area, and uniform electrification at the early stage can be performed. Therefore, it can be considered that it becomes possible to obtain toner showing enhanced developing speed, excellent durability, no fogging even in the use extending over a long period of time, and showing excellent transfer and cleaning properties, and more particularly, excellent blade-cleaning properties as mentioned.

(1) Structure and manufacturing method of toner

The toner of the present invention has a characteristic feature that BET specific surface area is not less than 5 $m^2/g$. From technical point of view, the BET value is not more than 150 $m^2/g$, preferably, not more than 100 $m^2/g$, and, particularly preferably 5 to 50 $m^2/g$. Furthermore, with respect to the above-mentioned range, the BET value is preferably 5 to 40 $m^2/g$ and, more preferably, 10 to 40 $m^2/g$. This BET specific surface area is measured by using one-point method of nitrogen adsorption method and, as a specific measuring equipment, "FLOWSORB 2300(produced by Shimazu Seisakusho Co., Ltd.) can be mentioned.

That is to say, toner particles having excessively large BET specific surface area have a lot of fine uneven surface, so that manufacturing itself is difficult. Moreover, even if particles having this uneven surfaces are obtainable, the surface roughness may be finer than that required for electrification, so that effect will attain in the saturated state.

It is preferable that the toner of the present invention at least comprises resin and a coloring agent. If necessary, the toner may be comprise a releasing agent, a charge controlling agent, etc. Further, external additives consisting of inorganic or organic fine particles may be added to colored particles composed of a resin and a colorant. In anyway, the toner particles of the present invention have high BET specific surface area.

The toner of the present invention can be manufactured by, for example, adding necessary additives to monomers, mixing and emulsion polymerizing the mixture so as to make fine polymer particles, and ,thereafter, coagulating by adding other additives such as organic solvents, coagulant.

With regard to the method of manufacturing toner of the present invention, there is no specific limitation as above-mentioned, however, those methods disclosed in Japanese Patent O.P.I. Publication Nos. 265,252 (1993) and 329,947 (1994) can preferably be applied. That is to say, the toner having the BET specific surface area of the present invention can be formed by a method of coagulating a plural kinds of fine particles consisting of resin, colorant, etc., and, in particular, after dispersing these constituents in water in the presence of an emulsifying agent, treating with a coagulant at a concentration of not less than their critical coagulation concentration, a nonionic surface active agent and an organic solvent being infinitely miscible with water, and thereafter performing heat fusion at a temperature of not less than the glass transition point of the produced polymer, the toner having the BET specific surface area of the present invention can be formed.

As to the nonionic surface active agent, in the present invention, the nonionic surface active agent is a surface active agent not having a ionic-dissociation group. Specifically, a surface active agent having oxyethylene unit ($—CH_2CH_2—O—$) or oxypropylene unit, $$(—\overset{\overset{\displaystyle CH_3}{|}}{CH}—CH_2—O—),$$

is preferably used

Specifically, the following exemplified compounds can be preferably mentioned.

Polyoxyethylene octyl phenyl ether (an average oxyethylene unit number of 5),

Polyoxyethylene octyl phenyl ether (an average oxyethylene unit number of 10),

Polyoxyethylene octyl phenyl ether (an average oxyethylene unit number of 15),

Polyoxyethylene octyl phenyl ether (an average oxyethylene unit number of 20);

Polyoxyethylene nonyl phenyl ether (an average oxyethylene unit number of 5),

Polyoxyethylene nonyl phenyl ether (an average oxyethylene unit number of 10),

Polyoxyethylene nonyl phenyl ether (an average oxyethylene unit number of 15),

Polyoxyethylene nonyl phenyl ether (an average oxyethylene unit number of 20);

Polyoxyethylene lauryl ether (an average oxyethylene unit number of 5),

Polyoxyethylene lauryl ether (an average oxyethylene unit number of 10),

Polyoxyethylene lauryl ether (an average oxyethylene unit number of 10),

Polyoxyethylene lauryl ether (an average oxyethylene unit number of 20);

Polyoxyethylene tridecyl ether (an average oxyethylene unit number of 5),

Polyoxyethylene tridecyl ether (an average oxyethylene unit number of 10),

Polyoxyethylene tridecyl ether (an average oxyethylene unit number of 15),

Polyoxyethylene tridecyl ether (an average oxyethylene unit number of 20);

Polyoxyethylene cetyl ether (an average oxyethylene unit number of 5),

Polyoxyethylene cetyl ether (an average oxyethylene unit number of 10),

Polyoxyethylene cetyl ether (an average oxyethylene unit number of 15),

Polyoxyethylene cetyl ether (an average oxyethylene unit number of 20);

Polyoxyethylene stearyl ether (an average oxyethylene unit number of 5),

Polyoxyethylene stearyl ether (an average oxyethylene unit number of 10),

Polyoxyethylene stearyl ether (an average oxyethylene unit number of 15),

Polyoxyethylene stearyl ether (an average oxyethylene unit number of 20);

Polyoxyethylene oleyl ether (an average oxyethylene unit number of 5),

Polyoxyethylene oleyl ether (an average oxyethylene unit number of 10),

Polyoxyethylene oleyl ether (an average oxyethylene unit number of 15),

Polyoxyethylene oleyl ether (an average oxyethylene unit number of 20);

Polyoxypropylene octyl phenyl ether (an average oxypropylene unit number of 5),

Polyoxypropylene octyl phenyl ether (an average oxypropylene unit number of 10), Polyoxypropylene octyl phenyl ether (an average oxypropylene unit number 15), Polyoxypropylene octyl phenyl ether (an average oxypropylene unit number 20);

Polyoxypropylene nonyl phenyl ether (an average oxypropylene unit number of 5),

Polyoxypropylene nonyl phenyl ether (an average oxypropylene unit number of 10), Polyoxypropylene nonyl phenyl ether (an average oxypropylene unit number 15), Polyoxypropylene nonyl phenyl ether (an average oxypropylene unit number 20);

Polyoxypropylene lauryl ether (an average oxypropylene unit number of 5),

Polyoxypropylene lauryl ether (an average oxypropylene unit number of 10),

Polyoxypropylene lauryl ether (an average oxypropylene unit number 15),

Polyoxypropylene lauryl ether (an average oxypropylene unit number 20);

Polyoxypropylene tridecyl ether (an average oxypropylene unit number of 5),

Polyoxypropylene tridecyl ether (an average oxypropylene unit number of 10),

Polyoxypropylene tridecyl ether (an average oxypropylene unit number 15),

Polyoxypropylene tridecyl ether (an average oxypropylene unit number 20);

Polyoxypropylene cetyl ether (an average oxypropylene unit number of 5),

Polyoxypropylene cetyl ether (an average oxypropylene unit number of 10),

Polyoxypropylene cetyl ether (an average oxypropylene unit number 15),

Polyoxypropylene cetyl ether (an average oxypropylene unit number 20);

Polyoxypropylene stearyl ether (an average oxypropylene unit number of 5),

Polyoxypropylene stearyl ether (an average oxypropylene unit number of 10),

Polyoxypropylene stearyl ether (an average oxypropylene unit number 15),

Polyoxypropylene stearyl ether (an average oxypropylene unit number 20);

Polyoxypropylene oleyl ether (an average oxypropylene unit number of 5),

Polyoxypropylene oleyl ether (an average oxypropylene unit number of 10),

Polyoxypropylene oleyl ether (an average oxypropylene unit number 15),

Polyoxypropylene oleyl ether (an average oxypropylene unit number 20).

In the present invention, the nonionic surface active agent is added in an amount of 10 through 100% by weight of produced polymer particles, and more preferably, the nonionic surface active agent is added in an amount of 50 through 100% by weight of produced polymer.

Further, in the present invention, the above-mentioned nonionic surface active agent and the organic solvent being infinitely miscible with water may be employed simultaneously or separately. It is preferable that the nonionic surface active agent and the organic solvent being infinitely miscible with water are employed simultaneously.

In the present invention, coagulated material is heated at a temperature of not less than the glass transition point (Tg) of the resin so as to form a fused material, and, preferably, the temperature is set to be Tg of the resin to Tg plus 50° C. of the resin, and more preferably, the temperature is set to be Tg to Tg plus 30° C. of the resin.

In the present invention, it is preferable that the coagulated material is heated at the temperature of not less than the glass transition point of the resin for a time of 2 hours to 10 hours.

Specifically, as monomers which constitute the resin, for example, the following monomers can be preferably mentioned:

Styrene or styrene derivatives thereof such as styrene, o-methylstyrene, m-methylstyrene, p-methylstyrene, p-chlorostyrene, 3,4-dichlorostyrene, p-phenyl styrene, p-ethylstyrene, 2,4-dimethylstyrene, p-t-butylstyrene, p-n-hexylstyrene, p-n-octylstyrene, p-n-nonylstyrene, p-n-decylstyrene and p-n-dodecyl styrene; methacrylate derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate, etc.; acrylate derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, etc.; olefins such as ethylene, propylene, isobutylene, etc.; halogenated vinyl compounds such as vinyl chloride, vinylidene chloride, vinyl bromide, vinyl fluoride, vinylidene fluoride, etc.; vinyl esters such as vinyl propionate, vinyl acetate, vinyl benzoate, etc.; vinyl ethers such as vinylmethyl ether, vinylethyl ether, etc.; vinyl ketones such as vinylmethyl ketone, vinylethyl ketone, vinylhexyl ketone, etc.; N-vinyl compounds such as N-vinyl carbazole, N-vinyl indole, N-vinyl pyrrolidone, etc.; vinyl compounds such as vinyl naphthalene, vinyl pyridine, etc.; acrylic acid derivatives or methacrylic acid derivatives such as acrylonitrile, methacrylonitrile, acrylamide, etc. can be mentioned. Among of the above-mentioned monomers, aromatic vinyl compound or α-methylene aliphatic monocarboxylate is preferably employed.

These vinyl-type monomers may be used either singly or two or more kinds in combination. Moreover, it is preferable that monomers having an ionic dissociating group are used in combination as monomers which constitutes the resin. The monomer containing an ionic dissociating group as a constituent of the monomer includes, for example, a carboxyl group, a sulfo group and a phospho group. More specifically, for example, an acrylic acid, methacrylic acid, maleic acid, itaconic acid, cinnamic acid, fumaric acid, maleic acid monoalkylate, itaconic acid mono-alkylate, styrene sulfonic acid, allylsulfo succinic acid, 2-acrylamide-2-methylpropane sulfonic acid, acid phosphoxyethyl methacrylate, 3-chloro-2-acidphosphoxy propyl methacrylate, etc. can be mentioned. It is preferable that these ionic dissociation groups are substituted by a multivalent metal atom such as a zinc, a magnesium, and the resin forms a metal-bridged structure.

Further, by using multi-functional vinyl compounds as a monomer such as divinyl benzene, ethyleneglycol dimethacrylate, ethyleneglycol diacrylate, diethyleneglycol dimethacrylate, diethyleneglycol diacrylate, triethyleneglycol dimethacrylate, triethyleneglycol diacrylate, neopentylglycol dimethacrylate, neopentylglycol diacrylate, etc., a resin having a cross-linking structure may also be formed.

These monomers may be polymerized by using a radical polymerization initiator so as to form a resin. In this case, an oil-soluble polymerization initiator may also be used in a suspension polymerization method and a solution polymerization method. As the oil-soluble polymerization initiator, for example, azoisobutylonitrile, lauryl peroxide, benzoyl peroxide, etc. may be used. Further when an emulsification polymerization method is applied, a water-soluble radical polymerization initiator may be used. As the water-soluble polymerization initiator, for example, persulfates such as potassium persulfate or ammonium persulfate, azobisaminodipropane acetate, azobiscyanovaleic acid or salts thereof, hydroxy peroxide, etc. may be mentioned.

As a resin employed in the present invention, resins having the glass transition point of 20° C. to 90° C. are preferably employed, and resins having the softening point of 80° C. to 220° C. are preferably employed. Herein, the glass transition point is measured by differential thermal analysis, and the softening point can be measured by a descending type flow tester.

In the present invention, as to a number average molecular weight (Mn) of the resin is 1,000 to 500,000, and preferably, 1,000 to 100,000.

In the present invention, as to a weight average molecular weight (Mw) of the resin is 2,000 to 1,000,000, and preferably, 2,000 to 100,000.

The number average molecular weight (Mn) and the weight average molecular weight (Mw) are measured by gel permeation chromatography (GPC). Still further, as a molecular weight distribution, Mw/Mn is not more than 100, preferably, not more than 70, more preferably, less than 5.0, and particularly preferably, 2.0 to 3.0.

Measurement of the molecular weight by GPC is carried out by flowing tetrahydrofurane at the flow rate of 1.0 ml/min at 40° C. and is measured by sampling 100 μl of 0.01 g of resin/20 ml of tetrahydrofuran. A molecular weight of a sample is measured at a specific measurement condition, wherein a calibration curve is prepared by measuring some monodispersed polystyrenes, and the correlation between a logarithm of the molecular weight of the calibration curve and a count number of the calibration curve becomes linear. A peak molecular weight is calculated by the use of the above-mentioned calibration curve with reference to the count number of the obtained GPC chromatography.

In the present invention, when the resin is particularly obtained by emulsion polymerization, the resin is prepared in the form of fine particles, and then, adding a coagulant, a solvent which is infinitely miscible with water, and the resin thus obtained is heated at the temperature higher than the glass transition point of the resin, preferable resin particles for toner can be obtained.

There is no specific limitation as to a coagulant used in the manufacture of the toner of the present invention, however, the coagulants selected from metal salts are preferable. Specifically, mono-valent metals, for example, metal salts of an alkaline metal such as sodium, potassium, lithium, etc., and examples of di-valent metals, for example, metal salts of alkaline earth metals such as calcium, magnesium, etc., salts of divalent metals such as manganese, copper, etc., salts of tri-valent metals such as iron, aluminum, etc. can be mentioned. Furthermore, as specific salts, sodium chloride, potassium chloride, lithium chloride, calcium chloride, zinc sulfate, copper sulfate, magnesium sulfate, manganese sulfate, etc. can be mentioned. These compounds may also be used in combination.

These coagulants are used by adding in amounts of not less than the critical coagulation concentration. This term "the critical coagulation concentration" is an index showing stability of aqueous dispersions, and indicates the concentration at which coagulations take place. This critical coagulation concentration varies to a large extent depending on the nature of the constituent to be dispersed and the dispersant itself. These are described in, for example, "Polymer Chemistry edited by the Society of Polymer Chemistry of Japan", Vol. 1, 17, page 601 (1960), authorized by Seizo Okamura et al., and, thereby, detailed critical coagulation concentrations values can be obtained. Still further, as another means, adding an appropriate salt to a dispersion containing object particles, and ζ-potential of the dispersion is measured, and, when ζ-potential is varied at a specific concentration of the salt, the specified salt concentration can be defined as the critical coagulation concentration of the dispersion.

The amount of the coagulant added in the present invention may be optional as long as the concentration of not less than the critical coagulation concentration, but is preferably at least 1.2 times, and more preferably at least 1.5 times that of the critical coagulation concentration.

Solvents being infinitely miscible with water are defined as solvents being infinitely soluble in a dyed polymer dispersion, so called, an aqueous dispersion, and this solvent is selected from the solvents wherein the produced resins are not soluble in the solvents. More specifically, They include, for example, alcohols such as methanol, ethanol, propanol, isopropanol, t-butanol, methoxyethanol and butoxyethanol, etc.; nitrites such as acetonitrile, etc. and ethers such as dioxane, etc. can be mentioned. Particularly, ethanol, propanol, isopropanol, are preferably employed.

The addition amount of this infinitely water-miscible solvent is preferably 1 to 300% by volume of the polymer containing dispersion, into which the coagulant has been added.

A variety of methods can be applied as polymerization method for forming the resin used for the toner of the present invention, and particularly, the above-mentioned emulsion polymerization method can be preferably employed.

As coloring agents which can be employed in the toner of the present invention, carbon black, magnetic material, dyes and pigments can be used voluntarily. For the carbon black, for example, Channel black, Farness black, acetylene black, thermal black, lamp black, etc. can be mentioned. Examples of magnetic materials are ferromagnetic metals such as iron, nickel, cobalt, etc.; alloys containing these metals; compounds of the ferromagnetic metals such as ferrite, magnetite, etc.; alloys, which do not contain ferromagnetic metals but show ferromagnetic nature with heat treatment, such as so-called Heusler alloy like manganese-copper-aluminum alloy, manganese-copper-tin alloy, chromium dioxide, etc. Dye example are C.I. Solvent Red Nos. 1, 49, 52, 58, 63, 111 and 122; C.I. Solvent Yellow Nos. 19, 44, 77, 79, 81, 82, 93, 98, 103, 104, 112 and 162; C.I. Solvent Blue Nos. 25, 36, 60, 70, 93 and 95, etc., and these dyes may be used in combination. As pigments, for example, C.I. Pigment red Nos. 5, 48:1, 53:1, 57:1, 122, 139, 144, 149, 166, 177, 178, 222; C.I. Pigment orange Nos. 31 and 43; C. I. Pigment yellow Nos. 14, 17, 93, 94, 138; C.I. Pigment green No. 7; and C,I. Pigment blue Nos. 15:3, and 60, etc. can be used. These pigments may also be used in combination. These coloring agents having primary particles having number average primary particle size of about 10 to 200 nm, are preferably dispersed into the toner.

As addition method of the coloring material, a method, in which first prepare a polymer resin itself by emulsion polymerization, and then add the coloring agent in the step of coagulating the resin by adding the coagulant, or a method of adding the coloring agent in the step of polymerization of monomer, may be used. In the case wherein the coloring agent is added in the step of preparing the polymer, it is preferable to treat the surface of the polymer with a coupling agent etc., in order that radical polymerization is not restricted.

Further, as a fixing improving agent, low molecular weight polypropylene having a number average molecular weight of 1,500 to 9,000, or low molecular weight polyethylene may be added. Further, as charge controlling agents, azo-type metal complexes or quaternary ammonium salts may also be used.

Still further, in view of providing fluidity, inorganic or organic fine particles may be added to colored resin particles obtained from polymerization. In this case, inorganic fine particles are preferably used, and inorganic oxide particles such as silica, titania or alumina, etc. is also preferably used. In addition, using a silane coupling agent, a titanium coupling agent. etc., these inorganic fine particles are preferably conducted with hydrophobicity providing processing.

The toner of the present invention can be prepared by coagulating plurality of the above-mentioned polymers, and, in this case, it can be obtained by the following steps comprising:

adding a metal salt to the dispersion containing polymer particles under agitation, wherein said metal salt is added in an amount of not less than the critical coagulation concentration, adding the above-mentioned solvent being infinitely soluble in water, and heating the dispersion to a temperature of not less than the glass transition point of the polymer.

A particle size of the toner itself of the present invention is optional, however, the smaller the particle size is, the more remarkable is the improved effect of the present invention. Toner particles having a volume average particle size of 2 to 10 μm, are preferably employed, and, in particular preferably 3 to 9 μm.

This particle size can be controlled by coagulant concentration, addition amount of the solvent, or constituents of the polymer itself.

The toner of the present invention can be used in either case: when it is used as a mono-component magnetic toner, by incorporating a magnetic material in the resin, when it is used as a two-component developer by mixing with so-called carrier particles, or when the colored resin particles themselves are used as non-magnetic toner. However, in the present invention, it is preferable to use as a two-component type developer by mixing with carrier.

As carrier which constitutes a two-component developer, either non-coated carrier consisting of only magnetic particle such as iron or ferrite, or resin-coated carrier consisting of magnetic material surface coated with a resin, may be used. A volume average particle size of this carrier particles is preferably 30 to 150 μm. There is no specific limitation as to the resin used for coating the carrier particles, for example, styrene-acrylic resin can be mentioned Constitution of Image Formation There is no specific limitation as to a method of development in which the toner of the present invention is applied, and either so-called a contacting developing method or a non-contacting developing method may preferably be used. As for development using the contacting developing method, Layer thickness of the developer comprising the toner of the present invention at the development domain on the photoreceptor is 0.1 through 8 mm and preferably, 0.4 through 5 mm. Moreover, in this case, gap between the photoreceptor and the developer carrying member is preferably 0.15 through 7 mm, and more preferably, 0.2 through 4 mm.

In non-contacting developing method, developer layer formed on the developer carrying member, does not contact with the photoreceptor. The developer layer applied to this method is preferably formed with a thin layer. In this method, the developer layer having a thickness of 20 through 500 μm is formed on the developing domain on the developer carrying member, and the gap between the photoreceptor and the developer carrying member is not less than the developer layer thickness.

The toner of the present invention has excellent charge rising property, and is preferably employed for the noncontact developing method. Namely, a developing electric field varies to a large extent in the non-contact developing method, and even if a charge amount varies to a very small amount, developing performance is remarkably affected. In other words, even if a charged amount of a toner varies to a very small amount, a developing performance such as an image quality and a density etc., varies to a large extent. However, since the toner of the present invention has an excellent charge rising property, a charge amount varies to a small amount, and a stable charged amount can be obtained. Accordingly, even if a non-contact developing method is employed, a stable image can be formed for a long period of time.

In non-contact developing method, formation of the thin developer layer can be formed by using a magnetic blade, in which magnetic force is used, or a method of press-contacting a developer layer thickness-regulating member on the surface of the developer carrying member. Moreover, a method of contacting a urethane blade or a plate made of phosphor bronze and regulating the thickness of the developer layer can also be applied. Pressing force of the press-regulation member is preferably 1 to 15 gf/mm. when the pressing force is too small, transport of the developer tends to be unstable due to lack of regulating power. On the other hand, when the pressing force is too big, durability of the developer tends to deteriorate because of increased stress of the developer. Therefore, it is preferable that pressing force range is 3 to 10 gf/mm. Further, when development bias may be applied in the non-contact developing method, a direct current component only may be applied or an alternating current component may be applied.

As to size of the developer carrying member, one having diameter of 10 to 40 mm Φ is preferable. When the diameter is too small, the degree of mixing of the developer tends to be insufficient, and it is difficult to provide sufficient electrification on the toner particles. When, on the other hand the diameter is too large, centrifugal force to the developer tends to be large, and problem of scattering of the toner particles into the air is easily be caused.

Herein below, an example of the non-contact developing method is explained with reference to FIG. 1.

FIG. 1 is a conceptual drawing of a developing device which is suitably be used in the non-contact developing method. In the drawing, numerical symbol respectively denote as follows:

1 shows a photoreceptor, 2 shows a developer carrying member, 3 shows a two-component developer containing a toner of the present invention, 4 shows a developer layer thickness-regulating member, 5 shows a developing domain, 6 shows a developer layer, 7 shows a power source for forming an alternating electric field The two-component developer comprising the toner of the present invention is held by magnetic force on the developer carrying member 2, inside of which holds a magnet 2B, and is transported to the developing domain 5 by the movement of the development sleeve 2A. Upon this transport, thickness of the developer layer 6 is regulated by the developer layer thickness-regulation member 4 in order that thickness does not contact with the photoreceptor 1 at the developing domain 5.

The minimum distance (Dsd) of the developing domain is not less than the thickness of the developer layer 6, which is preferably not less than 20 to 500 μm, and is, for example, about 100 to 1,000 μm. The power source 7 to form the alternating electric field is preferably an alternating current having a frequency of 1 to 10 kHz and electric potential of one to three kvp-p. The power source 7, if necessary, may contain direct current component added to an alternative current in series. As direct current potential, 300 to 800 V is preferable.

Figure 2:
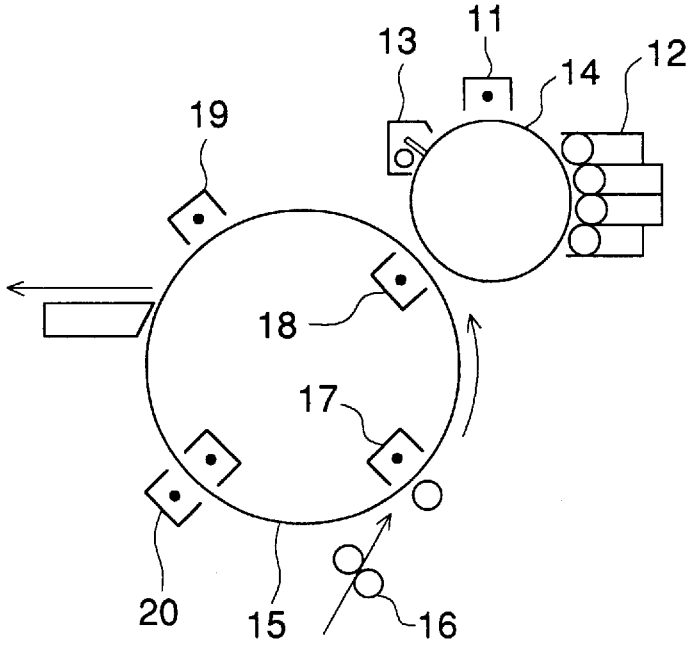
FIG. 2 is a conceptual drawing showing an example of successive transfer method.
Figure 3:
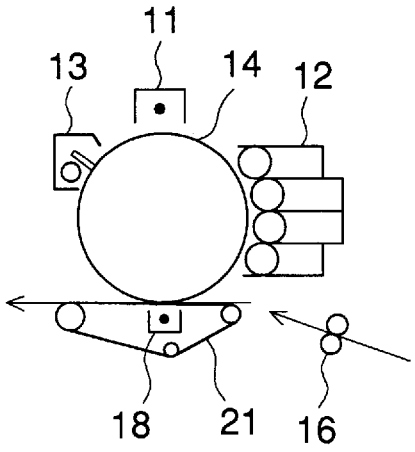
FIG. 3 is a conceptual drawing showing an example of simultaneous transfer method.

When the toner of the present invention is applied to color image forming method, a method, in which a monochromatic image is formed on the photoreceptor, then, transfers the image one by one onto an image carrying member, which is herein referred to as serial transfer method and is shown in FIG. 2, or a method, in which after a plurality of monochromatic images are developed, and then, after a color image is formed on the surface of the photoreceptor, this color image is then transferred onto the surface of an image carrying member, which is herein referred to as simultaneous transfer method and is shown in FIG. 3, can be applied.

Image forming methods shown in FIGS. 2 and 3 are detailed below.

As a developer carrying member used in the present invention, as shown in FIGS. 1, 2 and 3, a developing device in which holds a magnet 2B, is used, and as a sleeve 2A which constitute the surface of the developer carrying member, aluminum, aluminum subjected to surface oxidation processing or stainless steel can be used.

Below, the serial transfer method shown in FIG. 2 is explained.

Item 11 shows the charging device, which is an electrification electrode;

Item 12 shows a developing unit consisting of four developing vessels in which yellow, magenta, cyan and black toners are respectively loaded, and four vessels are separated in accordance with the above-mentioned four colors toners.

The basic structure of these developing vessels is the same as the conceptual drawing of the developing device shown in FIG. 1 in which the following numbers indicate the representative items.

14 shows photoreceptor drum, 13 shows cleaning unit, 15 shows a transfer drum, upon which a monochromatic color toner image is temporarily held, further, next monochromatic toner image is also held temporarily on the monochromatic color image, and, finally, an objective multi-color image is formed.

16 shows a transport unit which conveys a transfer material, onto which the toner image on the transfer drum is transferred, 17 shows an adsorption electrode which is provided inside the transfer drum 15, corona charging from within the transfer drum 15 and electrostatically adsorbing the transfer material on the drum, 18 shows a transfer electrode, with which the toner images formed on the photoreceptor 14 are successively transferred onto the transfer drum, 19 shows a peeling electrode to peel off the transfer material which was electrostatically adsorbed onto the transfer drum 15, 20 shows an eliminating electrode used to remove residual charge on the transfer drum after peeling off of the transfer material.

Uniform electrification is performed on the photoreceptor drum 14 using a charging electrode 11, and, thereafter an electrostatic latent image is formed by imagewise exposure (of which means is not shown in the drawing). This electrostatic latent image is developed with one color toner of developing unit 12 (for example, black toner) to form a toner image of a color on the photoreceptor 14. On the other hands, a transfer material which was transported on the transfer drum 15 by a transport unit 16, is electrostatically adsorbed on the transfer drum 15 by a n adsorption electrode 17 and transported to the transfer portion.

The above-mentioned toner image formed on the transfer drum 14 is transferred onto this transfer material. A toner is remained as a residual toner on the transfer drum 14 after transferred, then, this residual toner is collected by cleaning unit 13, and the collected toner is recycled in the next process.

In the case of forming a multi-colored image, the multi-colored toner images are formed by similar processes, specifically, a toner image having a color is formed by a developing, and then, the toner image is serially transferred on a transfer drum 15. Finally, an objective toner image is formed on a transfer material adsorbed on the transfer drum 15.

The transfer material on which the required toner image was produced, is removed with the peeling off electrode 19, and is transported to the fixing section, to produce a final fixed multi-color toner image. On the other hand, a residual charge on the transfer drum 15 is removed by using a discharger 20, and the transfer drum is employed in the next process.

Next, the simultaneous image transfer system is explained by referencing to FIG. 3.

Denotations of the respective portions of the equipment shown in FIG. 3 are omitted because they have the same denotations as FIG. 2, with the exception that item number 21 represents a transport section to transfer the toner image during transferred of the transfer material. Uniform electrostatic charges are formed by the electrification electrode on the photoreceptor drum 14, and, thereafter, an electrostatic latent image is formed by a latent image forming means, which is not illustrated in the drawing. This electrostatic latent image is developed with one of the color toners, for example, such as a black toner, installed in the developing unit 12, to form a toner image in one color on the photoreceptor drum. In the example as shown in the present drawing, this toner image is formed on the photoreceptor drum as it is, without being transferred, and, then the photoreceptor drum which bears the toner image, again uniformly charged with the electrification electrode 11, an electrostatic latent image is further formed, developed with a toner with a different color from that used in the first development, and, thus a toner image of another color is superimposed on the prior formed toner image. In the meantime, cleaning unit 13, transfer electrode 18 and transport section 21 are not active and withdrawn from the vicinity of the photoreceptor drum 14, so that they may not interfere with the just formed toner image.

Thus after the image formation is completed and multi-color toner images are formed, the toner image on the photoreceptor drum is transferred onto the transfer material transferred by a transfer unit 16, by the transfer electrode 18, while being transported by the transport section 21. The transfer material carrying the transferred toner image is transported to the fixing section, and, there, the toner image is fixed so as to form final multi-color toner images on the transfer material. On the photoreceptor drum 14 from which a toner image was transferred, toner is remained on the photoreceptor drum 14, and the toner is removed by the cleaning unit 13 and, the photoreceptor drum 14 is employed for the next process.

The toner image formed on the photoreceptor by the above-mentioned various methods, is transferred in the transfer step onto a transfer material such as a paper. There is no specific limitation as to the manner of transfer, and various methods such as so-called a corona transfer method or a roller transfer method, etc. can be employed.

The toner of the present invention has high transfer efficiency, and residual toner on the photoreceptor is small amount, for example, in the case of employing the toner in a blade-cleaning method, pressure of a cleaning blade on the photoreceptor material can be reduced, and further, the toner of the present invention provides longer life of the photoreceptor.

After the toner image was transferred onto the transfer material, residual toner on the photoreceptor is removed by the cleaning step, and the photoreceptor can be repeatedly employed for next process.

In the present invention, there is no specific limitation as to mechanism of cleaning, and various conventional cleaning methods such as blade cleaning method, magnetic brush cleaning method or furbrush cleaning method can voluntarily be applied. Among these cleaning methods, a preferable method is a blade cleaning method using so called, a cleaning blade in view of the reasons given herein-above.

Figure 4:
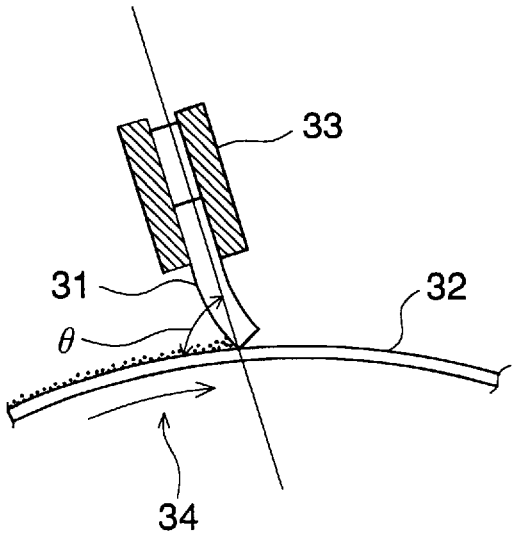
FIG. 4 is a conceptual drawing showing an example of blade cleaning method.
Figure 5:
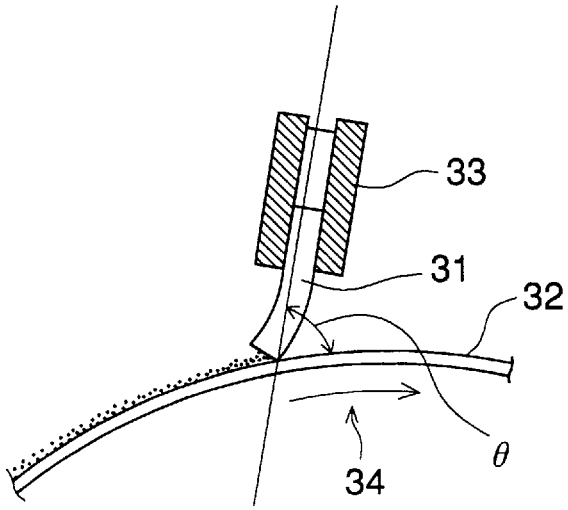
FIG. 5 is a conceptual drawing showing another example of blade cleaning method.

As a constitution of the blade cleaning method used for cleaning, either one illustrated in FIG. 4 or FIG., 5 can be applied. In FIGS. 4 and 5, a cleaning blade 31 is held by a holder 33. In these drawings, item number 32 denotes a photoreceptor, and item number 34 denotes the direction towards which the photoreceptor drum 32 rotates. Item θ shows an angle formed by the holder 33 and the photoreceptor 32, and in either case of FIG. 4 or FIG. 5, this angel θ is usually set to be 10 through 90°, and preferably, 15 through 75°. As materials constituting the cleaning blade 31, an elastic body such as silicone rubber or urethane rubber, etc. may be used. In this case, one having rubber hardness of 30° through 90° is preferable. Preferable thickness of the cleaning blade 31 is 1.5 to 5 mm, length of the holder member is preferably 5 to 20 mm, and compressing force against the photoreceptor is preferably 5 to 50 gf/mm.

EXAMPLES

Hereinbelow, effects of the present invention are specifically explained with reference to working examples.

Manufacturing Example 1 of Colored Particles 10.67 g of carbon black (Regal 330R, manufactured by Cabot co.), which has been treated with an aluminum coupling agent(Prenact A1-M, manufactured by Ajinomoto Co., Ltd.), was added to an aqueous solution containing 120 ml of pure water and 4.92 g of sodium dodecyl sulfate, and under agitation, the solution was subjected to ultrasonic vibration, to prepare an aqueous dispersion of carbon black. Apart from this, an emulsified dispersion containing 20% by weight of low molecular polypropylene, of which number average molecular weight is 3200 and was prepared by emulsifying low molecular weight polypropylene in water with a surface active agent while adding heat, was prepared. Then, to the above-mentioned dispersion of carbon black, 43 g of emulsified dispersion of low molecular weight polypropylene was mixed and, further, after 98.1 g of styrene monomer, 18.4 g of n-butyl acrylate monomer, 6.1 g of methacrylic acid monomer , 3.3 g of t-dodecyl mercaptan, and 850 ml of deaerated pure water were added, the mixture was heated to 70° C. under agitation with nitrogen gas flow. Next, 200 ml of pure water, in which 4.1 g of potassium persulfate was dissolved was added and the mixture was subjected to reaction at 70° C. for 6 hours. Thus obtained colored particles dispersion containing carbon black was defined as a dispersion 1. A primary particle diameter of the dispersion 1 is measured by a light-scattering electrophoresis particle-size analyzer ELS-800 (manufactured by Otsuka Denshi Kogyo co.,), and a molecular weight distribution of the dispersion 1 was measured by gelpermeation chromatography (GPC) in terms of styrene polymer. Thus obtained results were shown as Table 1.

To 600 ml of the dispersion 1, 160 ml of aqueous solution of potassium chloride of 2.7 mol/l was added, and further, 94 ml of isopropyl alcohol and 40 ml of pure water containing 5.4 g of polyoxyethleneoctylphenyleter (an average oxyethylene unit number of 10) were added. Thus mixtures were heated to 85° C., and were reacted for 6 hours. Then after completion of the reaction, the reaction solution was filtered, washed and dried so as to obtain colored particles of the present invention. This is hereinafter referred to as "colored particles 1".

Manufacturing Example 2 of Colored Particles

Colored particles 2 of the present invention were prepared in the same manner as manufacturing example 1, except that C. I. Pigment Blue 15:3 was used instead of the surface-treated carbon black of manufacturing example 1. Herein, thus obtained dispersion is hereinafter referred to as "Dispersion 2" and obtained color particles are hereinafter referred to as "Colored particles 2", respectively.

Manufacturing Example 3 of Colored Particles

Colored particles 3 of the present invention were prepared in the same manner as manufacturing example 1, except that C. I. Pigment Red 122 was used instead of the surface-treated carbon black of manufacturing example 1. Herein, the dispersion and the colored particles obtained in this example are hereinafter referred to as "Dispersion 3" and "Colored particles 3",respectively.

Manufacturing Example 4 of Colored Particles

Colored particles 4 of the present invention were prepared in the same manner as manufacturing example 1, except that C. I. Pigment Yellow 17 was used instead of the surface treated carbon black of manufacturing example 1. Herein, the dispersion and the colored particles obtained in this example are hereinafter referred to as "Dispersion 4" and "Colored particles 4", respectively.

Manufacturing Example 5 of Colored Particles

Colored particles 5 of the present invention were prepared in the same manner as manufacturing example 1, except that 150 ml of isopropyl alcohol added to "Dispersion 1" of manufacturing example 1. Herein, the dispersion and the colored particles obtained in this example is hereinafter referred to as "Dispersion 5" and "Colored particles 5" respectively.

Manufacturing Example 6 of Colored Particles

Colored particles 6 of the present invention were prepared in the same manner as manufacturing example 2, except that 250 ml of aqueous solution containing potassium chloride of 2.7 mol/l were added to "Dispersion 2" of manufacturing example 2. The colored particles obtained in this example is hereinafter referred to as "Colored particles 6".

Manufacturing Example 7 of Colored Particles

Colored particles 7 of the present invention were prepared in the same manner as manufacturing example 3, except that 68 ml of isopropyl alcohol and 200 ml of aqueous solution containing potassium chloride of 2.7 mol/l were added to Dispersion 3 of manufacturing example 3, respectively. The colored particles obtained in this example is hereinafter referred to as "Colored particles 7".

Manufacturing Example 8 of Colored Particles

Colored particles 8 of the present invention were prepared in the same manner as manufacturing example 4, except that "Dispersion 4" was used, and 72 ml of isopropyl alcohol and 200 ml of aqueous solution containing potassium chloride of 2.7 mol/l were added to Dispersion 4 of manufacturing example 4, respectively. The colored particles obtained in this example is hereinafter referred to as "Colored particles 8".

TABLE 1

(Dispersions)

| Sample No. | Number Average Primary Particle Diameter (μm) | Weight Average Molecular Weight (Mw) | Number Average Molecular Weight (Mn) | Mw/Mn |
|---|---|---|---|---|
| Dispersion 1 | 0.18 μm | $2.07 \times 10^4$ | $9.50 \times 10^3$ | 2.18 |
| Dispersion 2 | 0.25 μm | $1.85 \times 10^4$ | $8.81 \times 10^3$ | 2.10 |
| Dispersion 3 | 0.32 μm | $1.66 \times 10^4$ | $7.23 \times 10^3$ | 2.30 |
| Dispersion 4 | 0.48 μm | $1,98 \times 10^4$ | $8.79 \times 10^3$ | 2.26 |

Comparative Manufacturing Example 1 of Colored Particles

Using 100 parts of styrene-n-butyl acrylate copolymer (copolymerization ratio=85:15, weight average molecular weight=63,000), 10 parts of carbon black and 5 parts of low molecular weight polypropylene (number average molecular weight=3,200) were added, and the mixture was kneaded, pulverized and classified, to obtain Comparative colored particles. This is hereinafter referred to as "Comparative colored particles 1".

Comparative Manufacturing Example 2 of Colored Particles

Comparative colored particles 2 were prepared in the same manner as Comparative manufacturing example 1, except that C. I. Pigment Blue 15:3 was used instead of carbon black. Thus comparative colored particles were obtained. Herein, the comparative colored particles obtained in this example are hereinafter referred to as "Comparative Colored particles 2".

Comparative Manufacturing Example 3 of Colored Particles

Comparative colored particles 3 were prepared in the same manner as Comparative manufacturing example 1, except that C. I. Pigment Red 122 was used instead of carbon black. Herein, the colored particles obtained in this example is hereinafter referred to as "Comparative Colored particles 3".

Comparative Manufacturing Example 4 of Colored Particles

Comparative colored particles 4 were prepared in the same manner as Comparative manufacturing example 1, except that C. I. Pigment Yellow 17 was used instead of carbon black. Herein, the colored particles obtained in this example is hereinafter referred to as "Comparative Colored particles 4".

Manufacturing Example of Toners

To the above-mentioned "Colored particles 1" through "Colored particles 8", and "Comparative colored particles 1" through "Comparative colored particles 4", one weight % by weight of hydrophobic silica (primary number average particle diameter of 12 nm.) was added so as to obtain toners. Thus obtained toners were referred to as toners 1 through 8 and comparative toners 1 through 4, respectively.

Evaluation

Physical properties of the above-mentioned "Dispersion 1" through "Dispersion 4", "Colored particles 1" through "Colored particles 8", "Comparative colored particles 1" through "Comparative colored particles 4", "Toner 1" through "Toner 8", and "Comparative toner 1 through "Comparative toner" are shown in Tables 2 and 3.

As to the above-mentioned colored particles 1 to 8 and Comparative colored particles 1 to 4, each molecular weight distribution (Mw/Mn) is measured by the following condition, and, a peak molecular weight, a weight average molecular weight (Mw), a number average molecular weight (Mn) and Mw/Mn are calculated respectively.

A molecular weight measurement condition

| | |
|---|---|
| Apparatus: | HLC-8020 (produced by Toso Co.,). |
| Column: | GMHXL 2 columns, G2000HXL 1 column. |
| Detector: | RI |
| Rate of eluate: | 1.0 ml/minutes |
| Sample concentration: | 0.01 g/20 ml of THF (tetrahydrofuran) |
| Sampling amount: | 100 μl of Sample |
| Calibration curve: | Calibration curve is prepared by standard polystyrenes. |

As to the shape coefficients of toner particles, the toner particles are enlarged 1,000 times by the SEM (Scanning Electron Microscope), and the projected image is photographed to measure each L and each A of 150 samples by SPICCA (produced by NIPPON AVIONICS CO.,) and then, each of average values of L and A is calculated.

TABLE 2

(Colored Particles)

| Sample | Volume Average Particle Diamter (μm) | BET Value | Shape co-efficient | Mw × $10^4$ | Mn × $10^3$ | Mw/Mn |
|---|---|---|---|---|---|---|
| Colored Particles 1 | 5.60 | 22.1 | 1.129 | 2.07 | 9.50 | 2.18 |
| Colored Particles 2 | 5.32 | 20.4 | 1.134 | 1.85 | 8.81 | 2.10 |
| Colored Particles 3 | 5.21 | 24.6 | 1.140 | 1.66 | 7.23 | 2.30 |
| Colored Particles 4 | 5.56 | 26.7 | 1.151 | 1.98 | 8.79 | 2.26 |
| Colored Particles 5 | 7.52 | 14.7 | 1.095 | 2.07 | 9.50 | 2.18 |
| Colored Particles 6 | 5.15 | 17.8 | 1.042 | 1.85 | 8.81 | 2.10 |
| Colored Particles 7 | 5.59 | 37.2 | 1.342 | 1.66 | 7.23 | 2.30 |
| Colored Particles 8 | 5.73 | 30.5 | 1.311 | 1.98 | 8.79 | 2.26 |
| Comparative Colored Particles 1 | 5.91 | 3.21 | 1.193 | 26.0 | 9.0 | 28.89 |
| Comparative Colored Particles 2 | 6.01 | 3.29 | 1.191 | 26.0 | 9.0 | 28.89 |
| Conparative Colored Particles 3 | 5.82 | 3.93 | 1.205 | 26.0 | 9.0 | 28.89 |
| Conparative Colored Particles 4 | 5.92 | 3.87 | 1.189 | 26.0 | 9.0 | 28.89 |

TABLE 3

(Toner)

| Sample | Volume Average Pati-cle Diameter (μm) | BET Value |
|---|---|---|
| Toner 1 | 5.60 | 21.9 |
| Toner 2 | 5.32 | 21.8 |
| Toner 3 | 5.21 | 23.7 |
| Toner 4 | 5.56 | 28.4 |
| Toner 5 | 6.23 | 14.9 |
| Toner 6 | 8.44 | 19.1 |
| Toner 7 | 5.73 | 33.7 |
| Toner 8 | 5.80 | 28.5 |
| Comparative Toner 1 | 5.91 | 3.41 |
| Comparative Toner 2 | 6.01 | 3.51 |
| Comparative Toner 3 | 5.82 | 4.01 |
| Comparative Toner 4 | 5.92 | 3.69 |

The above-mentioned toners were mixed with ferrite carrier having a volume average particle diameter of 50 μm and being coated with a styrene-acrylic resin, so as to form developers having toner concentration of 7% by weight. In the present example, the developers corresponding to the above-mentioned "Toner 1" through "Toner 8" and "Comparative Toner 1" through "Comparative Toner 4" are referred to as "Developer 1" through "Developer 8" and "Comparative Developer 1" through "Comparative Developer 4", respectively. To evaluate the above-mentioned developers, the following copying apparatus was employed.

Evaluation in the Contact Developing Method

Evaluation was carried out by using a copying machine U-Bix3135, a product of Konica Corporation. In this example, thickness of developer layer was set to be 1.5 mm, and gap(Dsd between the photoreceptor and the developer carrier was set to be 0.5 mm.

As a cleaning device, one having the structure shown in FIG. 5, and the angle θ formed by the holder 33 and the photoreceptor 32 was 22°, and urethane rubber was used as the material used for constituting the cleaning blade 31. The rubber hardness of this urethane rubber was 65°, and thickness and the length of the holder member were 8 mm. Further, contacting force on the photoreceptor was 15 gf/mm.

The above-mentioned developers were evaluated by the following method, wherein 10,000 continuous copying were carried out at low temperature (10° C.), a low humidity (10% RH), then, the copying machine was left for 24 hours, and 60,000 copying were carried out. Then, after a pause, fog density generated in the first copying was measured. Obtained results were shown in the following Table 4.

Fog density was measured by using Macbeth densitometer Type Rd-918 and is represented as relative density when the density of the paper was normalized as zero. Further, for this evaluation, "Developer 1", "Developer 4", "Developer 5" and "Comparative Developer 1 were used.

TABLE 4

| Developer No. | At the Beginning | After 10,000th Copy | After 20,000th Copy | After 30,000th Copy | After 40,000th Copy | After 50,000th Copy | After 60,000th Copy |
|---|---|---|---|---|---|---|---|
| Developer 1 | 0.00 | 0.001 | 0.001 | 0.001 | 0.001 | 0.002 | 0.002 |
| Developer 4 | 0.00 | 0.001 | 0.001 | 0.001 | 0.001 | 0.002 | 0.002 |
| Developer 5 | 0.00 | 0.001 | 0.001 | 0.001 | 0.001 | 0.002 | 0.002 |
| Comparative Developer 2 | 0.00 | 0.002 | 0.003 | 0.004 | 0.006 | 0.009 | 0.012 |

From the results given in Table 4, it is understood that the developers of the present invention cause less fog generation even though a lot of copying are carried out, and stable copying performance can be obtained.

Evaluation in Non-contact Developing Method.

Non-contact developing method was explained with referring to FIG. 3. Applying this developing method a color copying apparatus U-Bix9028 (a product of a Konica Corporation) was employed. Simultaneous transfer method was performed in the similar manner as shown in FIG. 3, and one by one transfer method was performed in the similar manner as shown in FIG. 2. Image processing of the two type transfer methods is carried out by the following conditions.

A negatively electrifying lamination-type photoreceptor was employed as a photoreceptor, and as exposing light source a semi-conductive laser were used, respectively. And reversal development was carried out.

Photoreceptor surface potential: −550 V

DC bias: −250 V

AC bias: Vp-p: −50 to −450 V

Alternating frequency of the electric field: 1,800 Hz

Dsd: 300 μm

Pressure regulating force: 10 gf/mm

Pressure regulation bar: SUS416 (made of magnetic stainless)/: 3 mmϕ

Developer layer thickness: 150 mm

Development sleeve: 20 mm

In this example, as developer, "Developer 1" through "Developer 4", "Developer 5" through "Developer 8" and "Comparative Developer 1" through "Comparative Developer 4" were used in combination as a color developer. For evaluation, a full color image with picture element ratio of 75% was used, and under high temperature (33° C.) and high humidity conditions (80% RH), continuous running copying was performed. Copying was performed continuously until every 1,000th copies was completed, and after every 1,000 copies, the machine was left for 24 hours, and this procedure was repeated until 10,000 copies are completed. When uneven transfer is observed on transfer material, number of copies was recorded.

Results of the evaluation is shown in Tables 5 and 6.

TABLE 5

(One by one transfer method)

| Developer | Number of Copies at which Uneven Transfer Took Place |
|---|---|
| developers 1 through 4 | Not observed |
| Developer 5 through 8 | Not observed |
| Comparative Developer 1 | Uneven transfer was observed |

TABLE 5-continued (One by one transfer method)

| Developer | Number of Copies at which Uneven Transfer Took Place |
|---|---|
| through 4 | at 4000th copy |

TABLE 6

(Simultaneous Transfer method)

| Developer | Number of Copies at which Uneven Transfer Took Place |
|---|---|
| developers 1 through 4 | Not observed |
| Developer 5 through 8 | Not observed |
| Comparative Developer 1 through 4 | Uneven transfer was observed at 4000th copy |

From the results as shown in Tables 5 and 6, it is understood that superior results can be obtained in both cases of successive transfer method and the simultaneous transfer method without causing uneven transfer.

What is claimed is:

1. A toner for developing an electrostatic latent image by dry developer, said toner having a BET specific surface area of not less than 5 $m^2/g$, a shape coefficient of 1.01 to 1.5, and a volume average particle size of 3 to 9 μm.

2. The toner of claim 1, wherein said toner comprises a resin having a ratio of a weight average molecular weight (Mw) to a number average molecular weight (Mn) of not more than 100.

3. The toner of claim 1, wherein said toner comprises a resin having a ratio of a weight average molecular weight (Mw) to a number average molecular weight (Mn) of not more than 70.

4. The toner of claim 1, wherein said toner comprises a resin having a ratio of a weight average molecular weight (Mw) to a number average molecular weight (Mn) of less than 5.

5. The toner of claim 4, wherein said resin has a weight average molecular weight (Mw) of 2,000 to 1,000,000, and has a number average molecular weight (Mn) of 1,000 to 500,000.

6. The toner of claim 1, wherein said toner is prepared by a method of coagulating a plurality of particles, said particles comprising a resin and a colorant.

7. The toner of claim 1, wherein said toner has a shape coefficient of 1.05 to 1.3.

8. The toner of claim 1, wherein said toner comprises a resin having a ratio of a weight average molecular weight (Mw) to a number average molecular weight (Mn) of 2 to 3.

9. The toner of claim 1, wherein said toner has BET specific surface area of 5 to 150 $m^2/g$.

10. The toner of claim 1, wherein said toner has BET specific surface area of 5 to 100 $m^2/g$.

11. The toner of claim 1, wherein said toner has BET specific surface area of 5 to 50 $m^2/g$.

12. The toner of claim 1, wherein said toner has BET specific surface area of 5 to 40 $m^2/g$.

13. The toner of claim 1, wherein said toner has BET specific surface area of 10 to 40 $m^2/g$.

14. The toner of claim 1 prepared by coagulating a plurality of particles, said method comprising:

(a) dispersing a plurality of particles in water in the presence of an emulsifying agent, wherein said particles comprising a resin and a colorant to form a dispersed solution, (b) adding a coagulant to said dispersed solution so as to have a concentration of not less than a critical coagulation concentration of the dispersing material, (c) adding to said dispersed solution an organic solvent which is infinitely miscible with water, (d) adding a nonionic surface active agent to said dispersed solution, said (a), (b), (c), and (d) forming a coagulated material, and (e) heating said coagulated material at a temperature of not less than the glass transition point of said resin so as to form a fused material.

15. The toner of claim 1, said toner has a BET specific surface area of 10 to 40 $m^2/g$, a shape coefficient of 1.05 to 1.3.

16. A dry developer for developing an electrostatic latent image, said developer comprising a toner having BET specific surface area of not less than 5 $m^2/g$, a shape coefficient of 1.01 to 1.5 and a volume average particle size of 3 to 9 $\mu m$.

* * * * *